US010704317B2

(12) United States Patent
Strickland et al.

(10) Patent No.: US 10,704,317 B2
(45) Date of Patent: Jul. 7, 2020

(54) INSULATED REINFORCED DOOR PANEL AND DOOR FRAME WITH THERMAL BREAK

(71) Applicant: AADG, Inc, Milan, TN (US)

(72) Inventors: Bobby Neal Strickland, Trenton, TN (US); Jeffrey R. Badgett, Milan, TN (US); Charles Prentice Stewart, Milan, TN (US); Vince A. Hughes, Alamo, TN (US); Dale R. Childers, Milan, TN (US)

(73) Assignee: AADG, INC., Milan, TN (US)

( * ) Notice: Subject to any disclaimer, the term of this patent is extended or adjusted under 35 U.S.C. 154(b) by 0 days.

(21) Appl. No.: 16/117,004

(22) Filed: Aug. 30, 2018

(65) Prior Publication Data

US 2018/0371826 A1 Dec. 27, 2018

Related U.S. Application Data

(62) Division of application No. 15/662,936, filed on Jul. 28, 2017, now Pat. No. 10,273,742.

(Continued)

(51) Int. Cl.
*E06B 3/263* (2006.01)
*E06B 1/52* (2006.01)

(Continued)

(52) U.S. Cl.
CPC ..... *E06B 3/26305* (2013.01); *E06B 1/325* (2013.01); *E06B 1/52* (2013.01);

(Continued)

(58) Field of Classification Search
CPC ..... E06B 3/26305; E06B 3/822; E06B 1/52; E06B 1/325; E06B 3/76; E06B 3/726;

(Continued)

(56) References Cited

U.S. PATENT DOCUMENTS 1,159,411 A * 11/1915 Olberg ..... E06B 5/16 52/784.11
2,040,259 A * 5/1936 Johnson ..... E06B 3/7015 49/503

(Continued)

FOREIGN PATENT DOCUMENTS

EP 0213970 A2 11/1987

*Primary Examiner* — Brent W Herring
(74) *Attorney, Agent, or Firm* — DeLio Peterson & Curcio LLC; Thomas E. Ciesco

(57) ABSTRACT

A metal door frame for a door opening comprising at least one first door frame segment for upper or side portions of the door opening, the at least one first door frame segment having a first molding flange, a first jamb face adjacent to the molding flange, and a first stop flange adjacent to the jamb face. The metal door frame includes at least one second door frame segment for upper and side portions of the door opening, the at least one second door frame segment having a second molding flange, a second jamb face adjacent to the molding flange, a second stop flange adjacent to the jamb face, a second stop face adjacent to the stop flange, and a third stop flange adjacent to the stop face. The metal door frame includes a thermally insulative layer between the first door frame segment and the second door frame segment.

11 Claims, 6 Drawing Sheets

Related U.S. Application Data

(60) Provisional application No. 62/370,976, filed on Aug. 4, 2016, provisional application No. 62/370,970, filed on Aug. 4, 2016.

(51) Int. Cl.
*E06B 1/32* (2006.01)
*E06B 3/72* (2006.01)
*E06B 3/76* (2006.01)
*E06B 3/82* (2006.01)
*E06B 3/70* (2006.01)

(52) U.S. Cl.
CPC ..... *E06B 3/726* (2013.01); *E06B 3/76* (2013.01); *E06B 3/822* (2013.01); *E06B 3/26336* (2013.01); *E06B 2003/26309* (2013.01); *E06B 2003/7023* (2013.01); *E06B 2003/7076* (2013.01)

(58) Field of Classification Search
CPC ..... E06B 2003/7076; E06B 2003/7023; E06B 2003/26309; E06B 3/26336
USPC ..... 52/455, 784.1, 784.15
See application file for complete search history.

(56) References Cited

U.S. PATENT DOCUMENTS 2,742,117 A * 4/1956 Tolman ..... E06B 1/20 49/399
2,860,744 A * 11/1958 Mascari ..... E06B 1/20 52/212
2,948,366 A * 8/1960 Kelly ..... E06B 3/822 49/501
3,037,589 A * 6/1962 Cole ..... E06B 1/325 52/212
3,324,599 A * 6/1967 Brost ..... E06B 1/20 49/505
3,334,464 A * 8/1967 Charles ..... E06B 3/7015 52/784.15
3,571,995 A * 3/1971 Kasprzak ..... E06B 1/20 52/212
3,736,714 A * 6/1973 Brenner ..... E04B 2/766 52/300
3,906,671 A * 9/1975 Maldonado ..... E06B 1/20 49/505
4,553,286 A 11/1985 Schwarz
4,594,831 A 6/1986 Winyard
4,791,758 A * 12/1988 Bauer ..... E06B 1/20 49/505
4,930,257 A * 6/1990 Windgassen ..... E06B 1/325 49/400
5,187,898 A * 2/1993 McKann ..... E06B 1/20 49/505
5,218,807 A * 6/1993 Fulford ..... B32B 3/18 52/455
5,233,802 A * 8/1993 Rogers ..... E06B 1/20 49/505
5,361,552 A * 11/1994 Fulford ..... B32B 3/18 52/455
5,417,029 A * 5/1995 Hugus ..... E06B 3/822 52/792.1
5,765,333 A * 6/1998 Cunningham ..... E04B 1/165 52/281
5,813,187 A * 9/1998 Lee ..... E06B 9/01 52/106
6,286,274 B1 * 9/2001 McKann ..... E06B 1/20 49/505
6,643,991 B1 * 11/2003 Moyes ..... E06B 5/16 428/902
6,681,541 B2 * 1/2004 Wang Chen ..... E06B 5/16 52/309.9
7,690,629 B1 * 4/2010 Briggs ..... E04H 17/1413 256/21
8,418,427 B2 * 4/2013 Strickland ..... E06B 3/822 49/501
8,613,180 B2 * 12/2013 Strickland ..... E06B 3/822 49/501
8,733,066 B2 * 5/2014 Carlson ..... F25D 23/028 52/309.14
8,739,498 B2 * 6/2014 Wilkinson ..... E06B 3/827 52/232
8,782,975 B2 7/2014 Helton
9,016,030 B1 * 4/2015 Steele ..... E06B 3/726 52/784.11
9,234,349 B1 * 1/2016 Daiber ..... E04C 2/06
9,683,405 B2 * 6/2017 Sadeli ..... E06B 3/7001
9,834,981 B2 * 12/2017 Sadeli ..... E06B 3/7001
10,113,355 B2 * 10/2018 Wang ..... E06B 5/20
10,151,137 B2 * 12/2018 Glover ..... B29C 44/18
10,309,148 B2 * 6/2019 Glover ..... E06B 3/221
2002/0190617 A1 * 12/2002 Banicevic ..... F25D 23/02 312/321.5
2003/0005645 A1 * 1/2003 Wang Chen ..... E06B 5/16 49/501
2003/0033786 A1 * 2/2003 Yulkowski ..... E06B 5/16 52/784.15
2003/0056465 A1 * 3/2003 Banicevic ..... F25D 23/02 52/784.1
2004/0128947 A1 * 7/2004 Ito ..... E01F 8/0017 52/782.1
2005/0252126 A1 * 11/2005 Chan ..... E06B 3/822 52/309.9
2010/0257802 A1 * 10/2010 Strickland ..... E06B 3/822 52/404.3
2013/0167474 A1 * 7/2013 Carlson ..... F25D 23/028 52/784.15
2013/0180206 A1 * 7/2013 Strickland ..... E06B 3/822 52/784.15
2014/0047785 A1 * 2/2014 Wilkinson ..... E06B 3/827 52/232
2016/0265267 A1 * 9/2016 Sadeli ..... E06B 3/7001
2017/0022751 A1 * 1/2017 Wang ..... E06B 5/20
2017/0022752 A1 * 1/2017 Wang ..... E06B 5/20
2017/0030140 A1 * 2/2017 Nelson ..... E06B 5/20
2018/0051508 A1 * 2/2018 Glover ..... B29C 44/18
2018/0087315 A1 * 3/2018 Glover ..... E06B 3/221

* cited by examiner

INSULATED REINFORCED DOOR PANEL AND DOOR FRAME WITH THERMAL BREAK

BACKGROUND OF THE INVENTION

1. Field of the Invention

This invention relates to steel door frames and insulated door panels, and in particular, to frames having a thermal break to reduce conductive heat losses from one side of the frame to the other, and door panels having a cured-in-place internal structure for improving rigidity, thermal efficiency, aesthetics, and manufacturability.

2. Description of Related Art

Common commercial door openings are subject to thermal and air leakage, which results in higher energy costs for building owners. These door openings are also vulnerable to condensation and frost buildup, which may cause permanent damage and/or deformation of the door frames and panels under extreme circumstances. Furthermore, extreme difference of temperature and thermal forces between the building exterior and interior may result in deformation due to thermal bow.

SUMMARY OF THE INVENTION

Bearing in mind the problems and deficiencies of the prior art, it is therefore an object of the present invention to provide a door with a thermal break between the inner and outer frame segments.

It is another object of the present invention to provide a door frame resistant to air infiltration.

It is a further object of the present invention to provide a thermally resistant, reinforced door panel.

Yet another object of the present invention is to provide an insulated door panel resistant to thermal bow.

Still other objects and advantages of the invention will in part be obvious and will in part be apparent from the specification.

The above and other objects, which will be apparent to those skilled in the art, are achieved in the present invention which is directed in one aspect to a metal door frame for a door opening. The metal door frame comprises at least one first door frame segment for upper or side portions of the door opening, the at least one first door frame segment having a first molding flange, a first jamb face adjacent to the molding flange, and a first stop flange adjacent to the jamb face. The metal door frame includes at least one second door frame segment for upper and side portions of the door opening, the at least one second door frame segment having a second molding flange, a second jamb face adjacent to the molding flange, a second stop flange adjacent to the jamb face, a second stop face adjacent to the stop flange, and a third stop flange adjacent to the stop face. The metal door frame includes a thermally insulative layer between the at least one first door frame segment and the at least one second door frame segment. The third stop flange is disposed over the first stop flange. The thermally insulative layer is disposed between the third stop flange and the first stop flange. The at least one first door frame segment may include a first stop face adjacent to the first stop flange, wherein the second stop face is disposed over the first stop face and wherein the thermally insulative layer is disposed between the second stop face and the first stop face. In the at least one first door frame segment the first jamb face may be perpendicular to the molding flange and the first stop flange may be perpendicular to the jamb face, and in the at least one second door frame segment the second jamb face may be perpendicular to the molding flange, the second stop flange may be perpendicular to the jamb face, the second stop face may be perpendicular to the stop flange, and the third stop flange may be perpendicular to the stop face. The at least one first door frame segment may include a first stop face perpendicular to the first stop flange, wherein the second stop face is disposed over the first stop face and wherein the thermally insulative layer is disposed between the second stop face and the first stop face. The metal door frame may include first door frame segments for each of the upper and side portions of the door opening and a second door frame segments for each of the upper and side portions of the door opening. The first and second door frame segments may be made of steel. The thermally insulative layer may include an adhesive for securing the at least one first door frame segment to the at least one second door frame segment. The thermally insulative layer may be a double sided adhesive tape. The metal door frame may include a door secured by hinges within the door frame. The door may comprise a shell having spaced first and second exterior panels and frame members adjacent edges of the panels; a plurality of stiffeners in a shell interior portion extending along a length or width of the panels, ends of the stiffeners being received in frame members at opposite ends of the door shell; and a hardenable insulation material between adjacent exterior panels, stiffeners and frame members in the shell interior portion, the hardenable insulation providing both thermal insulation and an adhesive to bond the exterior panels, frame members and stiffeners. The door may comprise a shell having spaced first and second exterior panels and frame members adjacent edges of the panels; a plurality of stiffeners in a shell interior portion extending along a length or width of the panels, the stiffeners having a rectangular cross-section with sides and corners, the stiffener sides being oriented non-parallel with respect to the exterior panels; and a hardenable insulation material between adjacent stiffeners and frame members in the shell interior portion, the hardenable insulation providing both thermal insulation and an adhesive to bond the exterior panels, frame members and stiffeners.

Another aspect of the present invention is directed to a method of assembling and installing a metal door frame in a door opening. The method comprises providing for upper and side portions of the door opening first door frame segments, the first door frame segments having a first molding flange, a first jamb face adjacent to the molding flange, and a first stop flange adjacent to the jamb face. The method includes providing for upper and side portions of the door opening second door frame segments, the second door frame segments having a second molding flange, a second jamb face adjacent to the molding flange, a second stop flange adjacent to the jamb face, a second stop face adjacent to the stop flange, and a third stop flange adjacent to the stop face. The method includes providing a thermally insulative layer for thermal insulation between the first door frame segments and the second door frame segments and installing the first door frame segments to the upper and side portions of the door opening. The method includes placing the thermally insulative layer between an inside surface of the third stop flange, and an outside surface of the first stop flange and installing the second door frame segments to the upper and side portions of the door opening. The third stop flange is disposed over the first stop flange. The thermally insulative layer reduces thermal conductivity between the first and second door frame segments. The first door frame segments may include a first stop face adjacent to the first stop flange and the method may include installing the second stop face over the first stop face and the thermally insulative layer between the second stop face and the first stop face. The thermally insulative layer may include an adhesive for securing the first door frame segments to the second door frame segments and the method may include applying the thermally insulative adhesive to either or both of the inside surface of the third stop flange and the outside surface of the first stop flange, and adhering the third stop flange over the first stop flange. The method may include securing a door by hinges within the door frame.

Another aspect of the present invention is directed to an insulated panel which may be used as a door. The insulated panel comprises a shell having spaced first and second exterior panels and frame members adjacent edges of the panels. The insulated panel includes a plurality of stiffeners in a shell interior portion extending along a length or width of the panels, ends of the stiffeners being received in frame members at opposite ends of the door shell. The insulated panel includes a hardenable insulation material between adjacent exterior panels, stiffeners and frame members in the shell interior portion, the hardenable insulation providing both thermal insulation and an adhesive to bond the exterior panels, frame members and stiffeners. The frame members may have openings corresponding to a cross section of the ends of the stiffeners, the ends of the stiffeners being received within the frame member openings at opposite ends of the door shell. The stiffeners may have a rectangular cross-section with sides and corners, and wherein the stiffener sides are non-parallel with respect to the exterior panels. The stiffeners may be tubular and have a square cross-section, the diagonal dimension of the stiffener being at least half of the distance between the inside surfaces of the exterior panels. The insulation material may fill substantially all of the space between the adjacent exterior panels, stiffeners and frame members in the shell interior portion. The stiffeners and the liner panel may be made of steel.

Another aspect of the present invention is directed to a method of making an insulated panel which may be used as a door. The method includes providing first and second exterior panels for a door shell, frame members for the door shell and a plurality of stiffeners. The method includes assembling the first and second exterior panels, frame members and stiffeners to make a shell having spaced first and second exterior panels and frame members adjacent edges of the panels, the plurality of stiffeners are disposed in the shell interior portion extending along a length or width of the panels, with ends of the stiffeners being received in frame members at opposite ends of the door shell. The method includes injecting a curable and hardenable insulation material between adjacent exterior panels, stiffeners and frame members in the shell interior portion. The insulation when cured provides both thermal insulation and an adhesive to bond the exterior panels, frame members and stiffeners. The frame members may have openings corresponding to a cross section of the ends of the stiffeners, and the method may include placing the ends of the stiffeners being within the frame member openings at opposite ends of the door shell. The stiffeners may have a rectangular cross-section with sides and corners, and the method may include placing the ends of the stiffeners within the frame member such that the stiffener sides are non-parallel with respect to the exterior panels. The stiffeners may be tubular and have a square cross-section, and the diagonal dimension of the stiffener may be at least half of the distance between the inside surfaces of the exterior panels. The method may include filling the insulation material into substantially all of the space between the adjacent exterior panels, stiffeners and frame members in the shell interior portion.

Another aspect of the present invention is directed to an insulated panel which may be used as a door. The insulated panel comprises a shell having spaced first and second exterior panels and frame members adjacent edges of the panels. The insulated panel includes a plurality of stiffeners in a shell interior portion extending along a length or width of the panels, the stiffeners having a rectangular cross-section with sides and corners, the stiffener sides being oriented non-parallel with respect to the exterior panels. The insulated panel includes a hardenable insulation material between adjacent stiffeners and frame members in the shell interior portion, the hardenable insulation providing both thermal insulation and an adhesive to bond the exterior panels, frame members and stiffeners. The stiffeners may be tubular and have a square cross-section, the diagonal dimension of the stiffeners being at least half of the distance between inside surfaces of the exterior panels. The frame members may have openings corresponding to a cross section of the ends of the stiffeners, the ends of the stiffeners being received within the frame member openings at opposite ends of the door shell. The insulation material may fill substantially all of the space between the adjacent exterior panels, stiffeners and frame members in the shell interior portion. The stiffeners and the liner panel may be made of steel.

Another aspect of the present invention is directed to a method of making an insulated panel which may be used as a door. The method comprises providing first and second exterior panels for a door shell, frame members for the door shell and a plurality of stiffeners having a rectangular cross-section with sides and corners. The method includes assembling the first and second exterior panels, frame members and stiffeners to make a shell having spaced first and second exterior panels and frame members adjacent edges of the panels, the plurality of stiffeners being disposed in the shell interior portion extending along a length or width of the panels, with the stiffeners sides being oriented non-parallel with respect to the exterior panels. The method includes injecting a curable and hardenable insulation material between adjacent exterior panels, stiffeners and frame members in the shell interior portion, the insulation when cured providing both thermal insulation and an adhesive to bond the exterior panels, frame members and stiffeners. The stiffeners may be tubular and have a square cross-section, and the diagonal dimension of the stiffeners is at least half of the distance between inside surfaces of the exterior panels. The frame members may have openings corresponding to a cross section of the ends of the stiffeners, and the method may include placing the ends of the stiffeners within the frame member openings at opposite ends of the door shell. The method may include filling the insulation material into substantially all of the space between the adjacent exterior panels, stiffeners and frame members in the shell interior portion.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF EMBODIMENTS

In describing exemplary embodiments of the present invention, reference will be made herein to FIGS. 1-8 of the drawings in which like numerals refer to like features of the invention. Reference will also be made to the general direction of orientation of the door frame 120 and door panel 20 of the invention.

Figure 1:
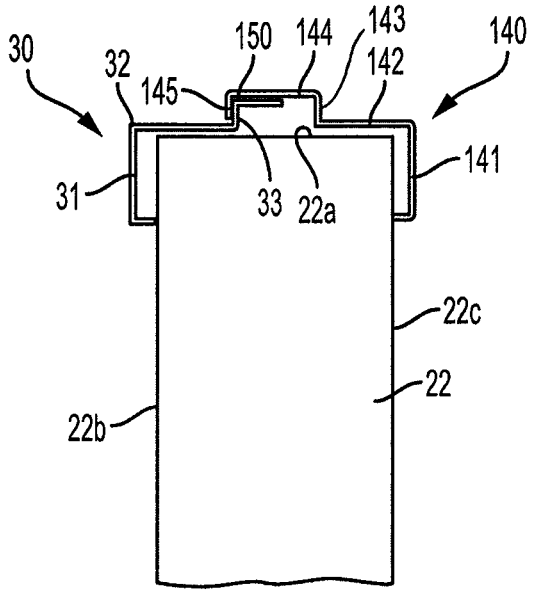
FIG. 1 is a cross-sectional view of an embodiment of the assembled door frame of the present invention.

The present invention is directed in part to door frames made of a metal or alloy, such as 16 gauge galvanized stamped steel sheet. An exemplary door frame 120 may comprise three (3) portions, an upper portion 24 disposed above the door opening, and two side portions 26, 28 disposed along either edge of the door opening, with one side portion 26 being on the hinge side of the door, and the opposite side portion 28 being on the latch side of the door. Each portion 24, 26, 28 may be made up of a pair of elongated frame segments 30, 140 of sufficient length to fit the door opening and door. The frame segments 30, 140 are assembled around the opening edges 22*a* of wall 22 (FIG. 1). Frame segment 30 is disposed on the inner side of the door opening, i.e., the side 22*b* of wall 22 that is normally enclosed by the door, and frame segment 140 is disposed on the outer side of the door opening, i.e., the side 22*c* of the wall that is normally outside the door. Inner frame segment 30 on the hinge side 26 may have openings for hinge reinforcements 27. The opposite inner frame segment 30 on the latch side may have an opening for a strike plate reinforcement 29. All segments 30, 140 are of sufficient length to extend around the door opening, and may be secured to each other and adjoining structure by variously configured tabs 25 made of appropriate structural material such as 18 gauge galvanized steel.

Figure 2:
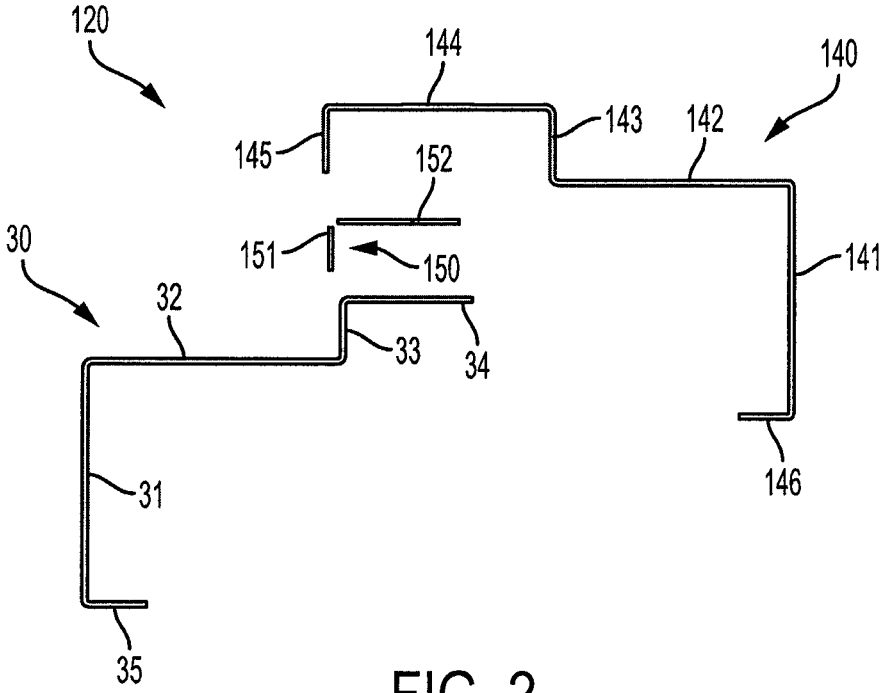
FIG. 2 is an exploded view of the door frame of FIG. 1.
Figure 3:
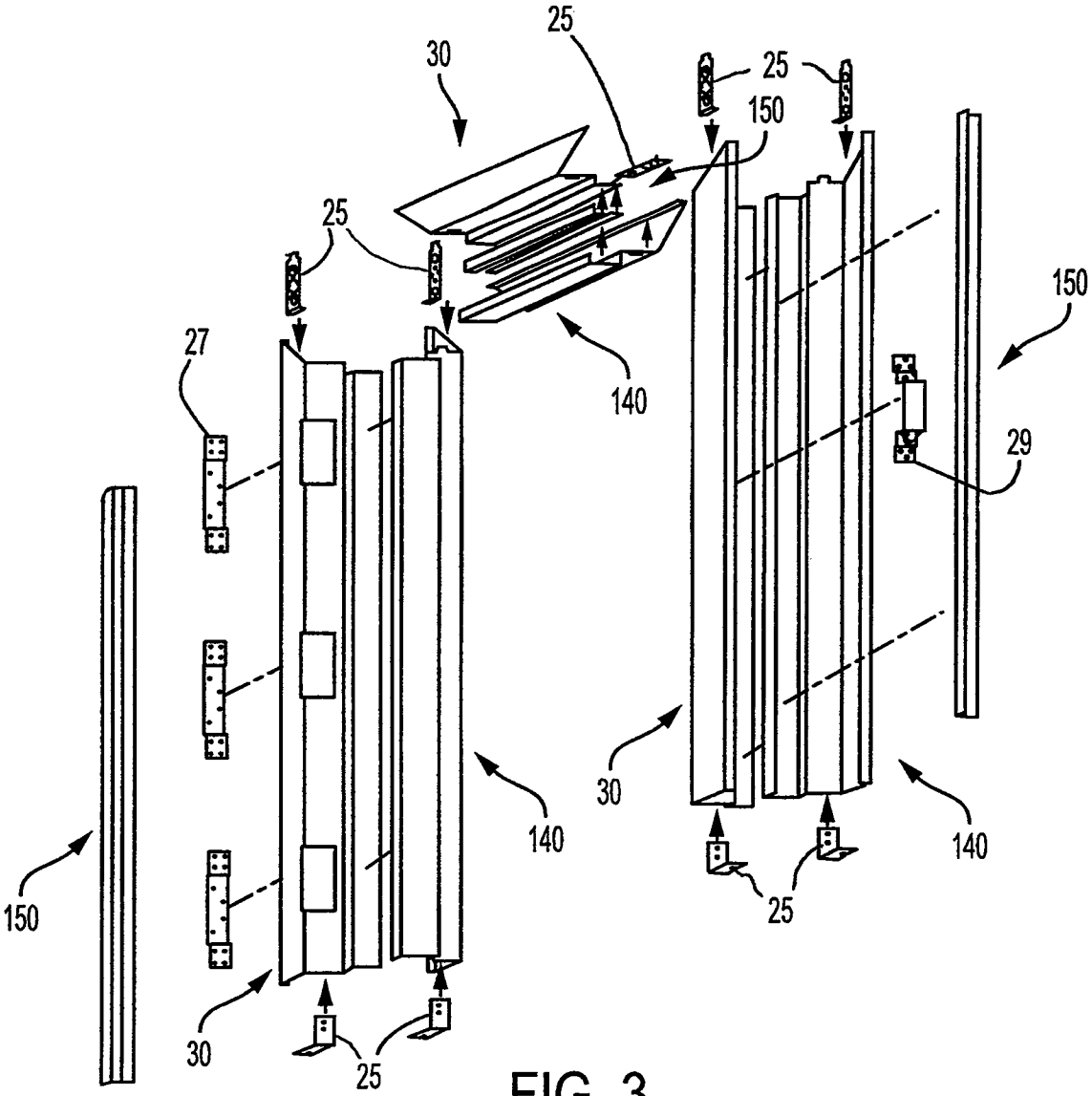
FIG. 3 is an exploded perspective view of the door frame of FIG. 1.
Figure 4:
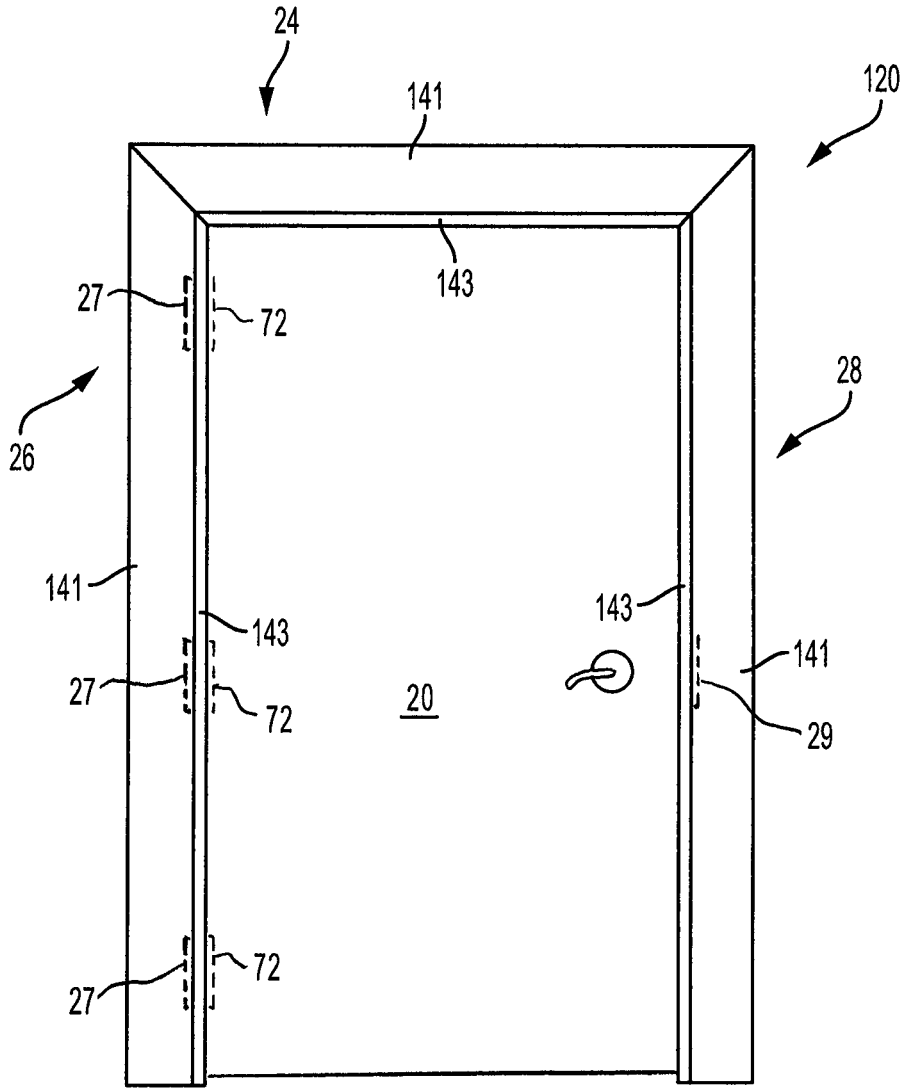
FIG. 4 is a front elevational view of one side of the assembled door frame of FIG. 1 in which is hung an insulated reinforced door panel according to the present invention.
Figure 5:
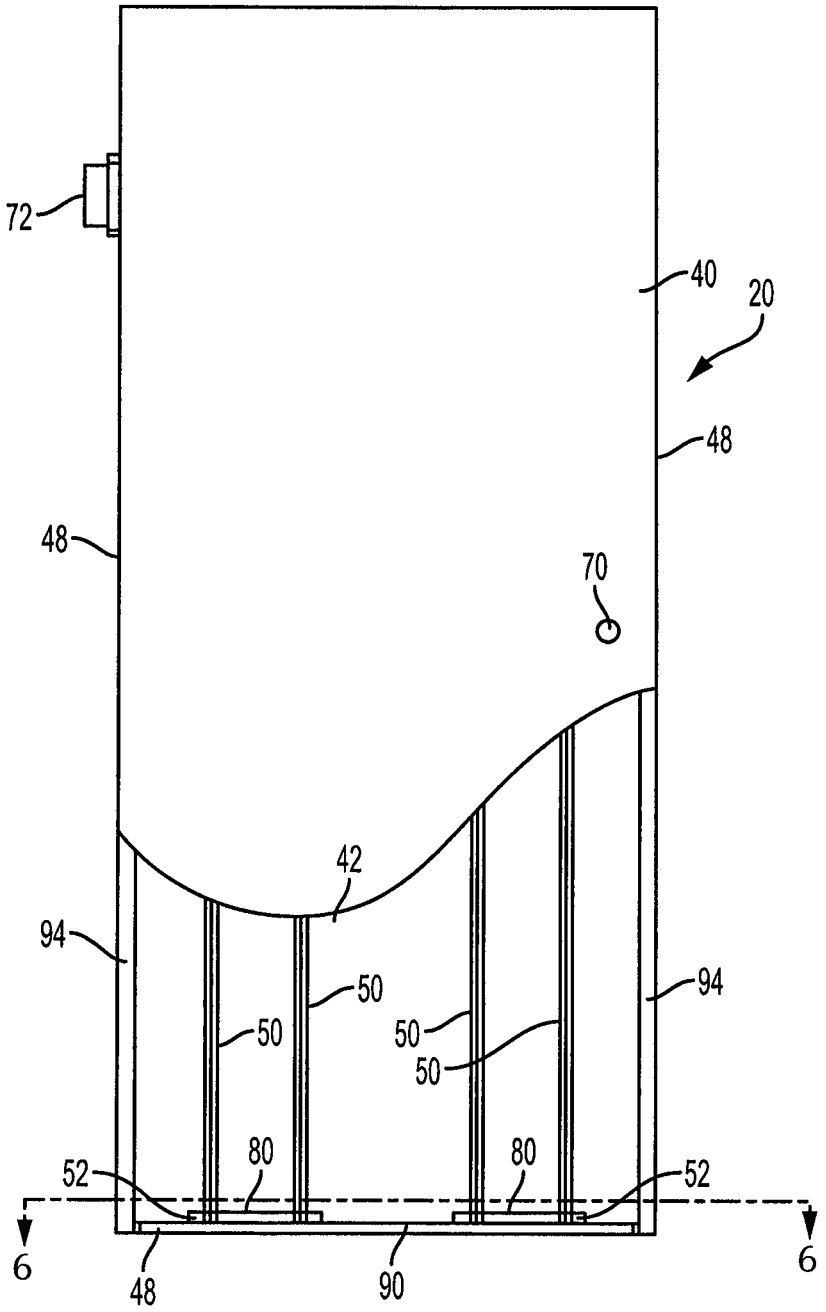
FIG. 5 is a front elevational view with partial cutaway of an embodiment of the insulated reinforced door panel shown in FIG. 4.
Figure 6:
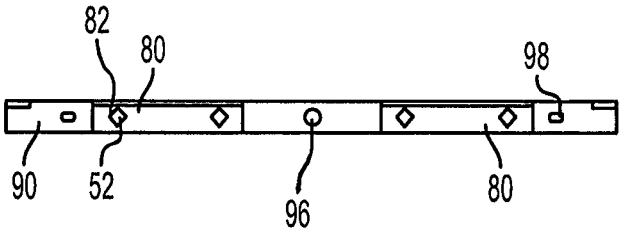
FIG. 6 is a cross section of the lower frame members of the insulated reinforced door panel of FIG. 5 along line 6-6.

As shown best in FIGS. 2 and 3, inner frame segment 30 has a flange 31 that forms the inner door opening molding, which is parallel to wall inner side 22*b* and spaced therefrom at one end by adjacent, perpendicular leg 35. Jamb face 32 extends adjacent to and perpendicularly from the other end of inner molding flange 31. A door stop is formed by inner stop flange 33 extending adjacent to and perpendicularly from the other end of face 32 and has extending adjacent to and perpendicularly from its inner stop face 34. Constructed as an essentially mirror image is outer frame segment 30 which has outer molding flange 141 parallel to wall outer side 22*c* and spaced therefrom at one end by adjacent, perpendicular leg 146. Jamb face 142 extends adjacent to and perpendicularly from the other end of flange 141. Outer stop flange 143 extends adjacent to and perpendicularly from the other end of jamb face 142 and has extending adjacent to and perpendicularly from its outer stop face 144. At the other end of outer stop face 144 is adjacent, perpendicular stop flange 145. The flanges, jamb faces, stop flanges and stop faces on each of the inner and outer frame segments extend substantially the entire distance of the door opening.

When assembled (FIG. 1), outer stop face 144 covers inner stop face 34, and stop flange 145 covers stop flange 33. A door 20 may be hung otherwise conventionally within the door opening (FIG. 4) by hinges secured by fasteners through openings to hinge reinforcements 27 in one or both of frame side portions 26, 28 so that the door edges contact stop flanges 143 or 145. Door 20 may be any otherwise conventional door, or may be a door constructed in accordance with the invention as described below and in FIGS. 5-8. The frame segments may be reversed from that shown, wherein frame segment 30 is disposed on the outer side of the wall, and frame segment 140 is disposed on the inner side of the wall.

Between the corresponding faces and flanges of the inner and outer frame segments is a thermally insulative layer or strip 150, which may have a layer of adhesive on one or both opposite sides. A double sided adhesive tape may be used made from a strip of plastic or other polymeric material, such as a compression-type closed cell polyurethane foam or other weather stripping, which has applied on both surfaces a pressure-sensitive adhesive. An example is Norton V2845 double-sided tape. The thermally insulative adhesive is applied in an "L" shape as segments 152, 151 between the lengths of facing surfaces of outer frame segment face 144 and flange 145, and inner frame segment face 34 and flange 33. Alternatively, a single strip bent into an "L" shape may be employed. The thermally insulative and adhesive material 150 provides structural connection between the inner and outer frame segments, forming a bonded thermal break that minimizes thermal conduction between the inner and outer frame segments. No screws, rivets or other metal fasteners are present or needed to connect the inner and outer frame segments, so that there is no bridge of metal to conduct heat from a warmer frame segment on one side of the door opening to a colder frame segment on the other side of the door opening.

In the method of assembling the door frame of the present invention, the inner and outer door frame segments are sized to fit the upper and side door opening dimensions. The inner door frame segments 30 are installed on the upper and side portions of the door opening using corner tabs and hanger tabs to secure to the wall around the door opening and adjacent segments. The thermally insulative layer 150 is then placed between the inner and outer door frame segments. This may be done by applying the adhesive on the layer to either or both of the inside surfaces of stop face 144 and stop flange 145 of the outer door frame segments 140, and the outside surfaces of the stop face 34 and the stop flange 33 of the inner door frame segments 30. The outer door frame segments 140 are then installed on the upper and side portions of the door opening, so that the stop faces 144 of outer door frame segments 140 are adhered over the stop faces 34 of the inner door frame segments 30, and the stop flanges 145 of the outer door frame segments 140 are adhered over the stop flanges 33 of the inner door frame segments 30.

The thermally insulative adhesive between the inner and outer door frame segments reduces thermal conductivity between the door frame segments. The door frame of the present invention is most advantageously used on an exterior wall of a building, where there are extremes in temperature between the building exterior and interior. Alternatively, it may also be used on interior walls where the door encloses a room from a hallway.

FIGS. 5, 6, 7, and 8 show an embodiment of the insulated reinforced door panel 20 of the present invention. The door shell includes an inner panel 40 and a spaced outer panel 42 opposite the inner panel. The inner panel 40 and outer panel 42 form the exterior panels of the door, and may also be referred to as the door skin. The exterior panels may be made of any suitable sheet material, for example a metal or alloy such as about 18 or 20 gauge steel, and may be flat or embossed. The insulated door 20 includes door edges 48 extending between the periphery of the inner and outer panels. Upper and lower door edges 48 are formed by elongated upper and lower frame members 90, formed from a metal or alloy such as about 16 or 18 gauge steel, which may have a "U" or "C" channel cross-section, and to which the inner and outer panels 40, 42 are welded or otherwise adhered. Side door edges 48 also have a "U" or "C" cross-section 94, which may be formed by folding the side edges of outer panel 42. There may be provided in the frame members one or more slots or openings 98 for hanging panel 20 during the manufacturing process, such as when painting, and one or more slots or openings 96 for injecting foam insulation (FIG. 6) (discussed further below). A preparation opening 70 for a lock and/or door handle may be provided, along with hinges 72 (FIG. 5) to secure the door to a door opening (not shown), such as the door frame described in above and in FIGS. 1-4. Although the panel 20 is shown in use as a door, alternatively, the present invention may be used as a wall or other structural panel, without the door hardware.

Figure 7:
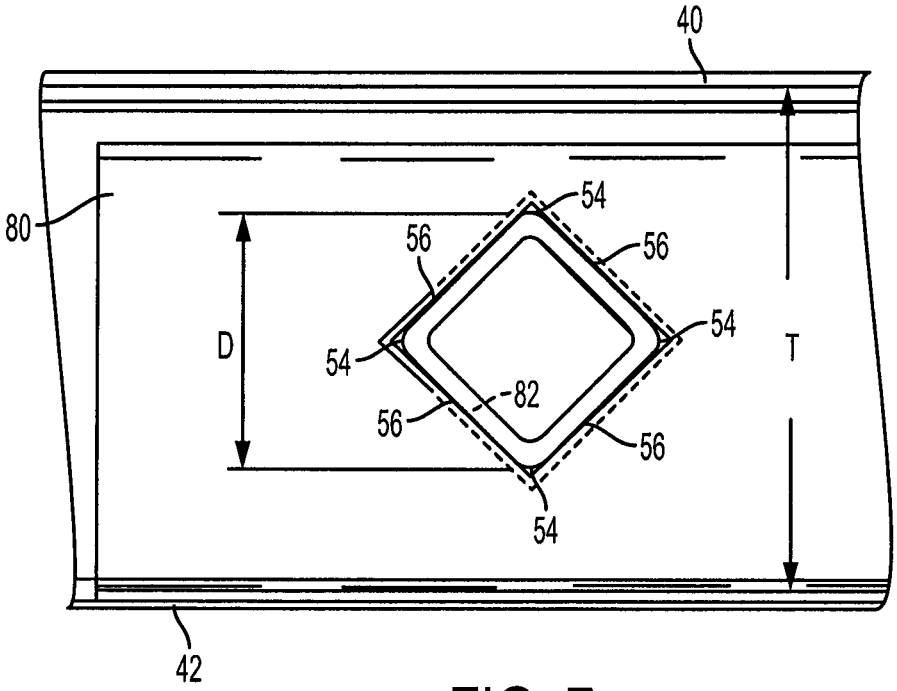
FIG. 7 is a close-up of the cross section of an exemplary stiffener fitted into the opening in the lower spindle channel of the insulated reinforced door panel of FIG. 6.
Figure 8:
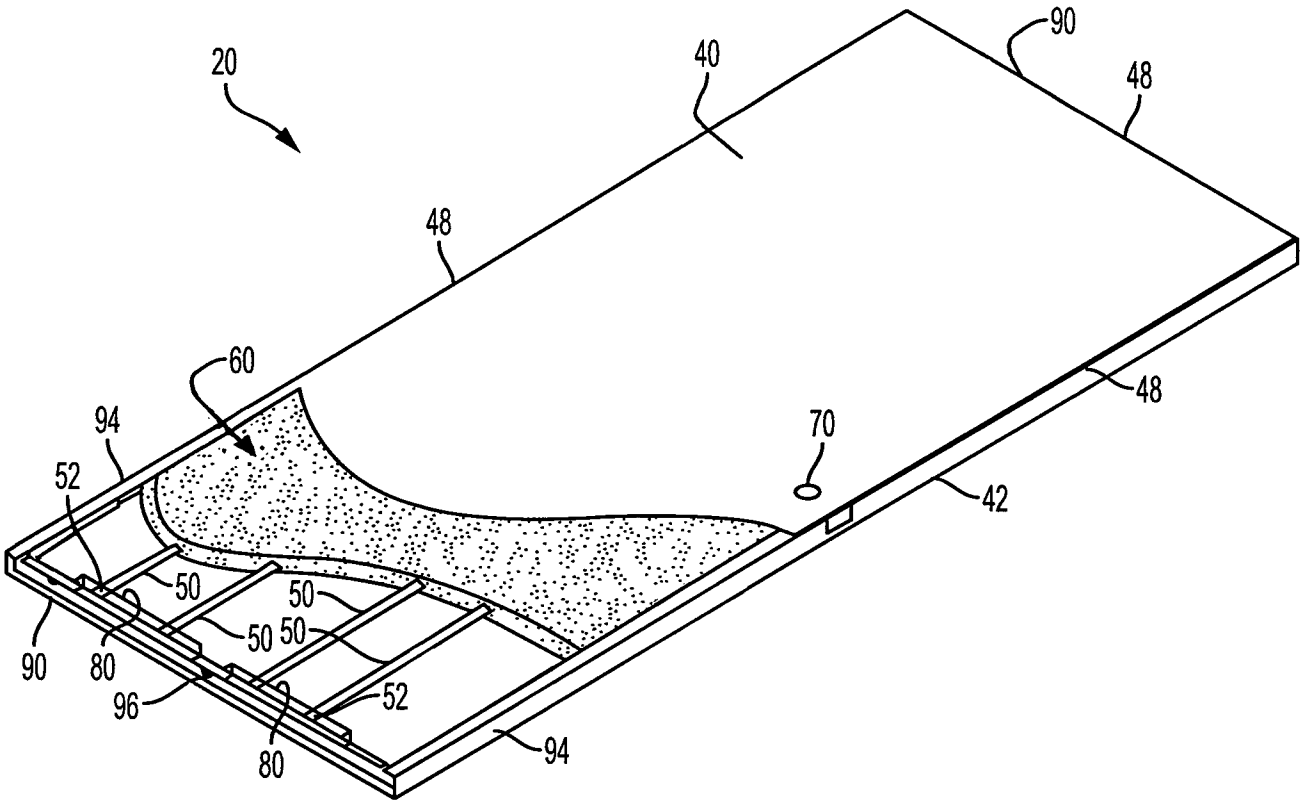
FIG. 8 is a rear perspective view with partial cutaway of the insulated reinforced door panel of FIG. 5.

In the interior portion between the inner and outer exterior panels a plurality of spaced-apart elongated structural stiffeners or spindles 50 extend substantially between the door edges. Although stiffeners 50 are shown extending vertically from the top to the bottom edges of the door, they may extend horizontally from one side to the other, or in any other direction. The stiffeners may be made of any suitable structural material, for example a metal or alloy such as hollow steel tube of 0.40 in (10 mm) thickness. The tube may be of any cross-section desired, such as rectangular or circular. A square cross-section may be used for stiffener 50 with sides 56 of a width of about 0.590 in. (15 mm) extending between four corners 54 (FIG. 7). As shown in FIGS. 7 and 8, the square stiffener is oriented in a "diamond" or diagonal configuration, with one pair of opposite corners 54 being oriented toward the inner and outer panels 40, 42 and the other pair of opposite corners 54 being oriented parallel to the inner and outer panels. The sides 56 are non-parallel with those panels, in this case at a 45° angle with respect thereto. Such orientation provides more resistance and strength against bending forces applied normal to the exterior panel surfaces. The diagonal dimension D of the stiffeners may span half or more of the interior door thickness T (FIG. 7), and should be provided in number and size to provide sufficient structural integrity to maintain the desired strength of the door. Stiffeners 50 may be sized and spaced from inner and outer door panels 40, 42, so a gap exists and there is no direct contact between the mid-portions of the stiffeners between ends 52 and the inner surface of the door skins. This provides a minimal thermally conductive bridge through the door thickness.

Optionally, the stiffeners may be oriented within the door so that their corners 54 contact the inner surfaces of the inner and outer panels 40, 42 in essentially line contact to minimize the conduction of heat through the door thickness.

To hold the stiffeners 50 in place within the door interior, the ends 52 are secured to positioning members shown as spindle end channels 80, formed from a metal or alloy such as about 18 gauge steel, which are themselves secured to frame members 90 at the top and bottom door edges 48. Stiffeners 50 may be secured to frame members directly. In the embodiment shown the stiffeners 50 are mechanically locked in position by providing openings 82 in the positioning members 80 that correspond in shape and size to the stiffener ends 52 (FIGS. 6 and 7), so that the ends are captured therein, and the stiffener ends cannot move from side-to-side and the stiffeners cannot rotate. The stiffener ends 52 have a tight sliding fit into the frame openings. Other bonding methods and materials may alternatively or additionally be used to secure the stiffener ends 52, including but not limited to welding, adhesives and mechanical fasteners. Both ends of the stiffeners are secured to the end channel positioning members, and similar positioning members 80 (not shown) are provided at the top end of door panel 20 secured to top frame 90 at top edge 48 between door skins 40, 42.

A curable and hardenable insulation material 60 is disposed between adjacent stiffeners and fills the interior cavity between the inner and outer panels 40, 42. The insulation material may be expanded foam such as BASF 21B density polyurethane expanding foam, using P50341 resin and Honeywell HFO blowing agent. The foam when cured acts to provide thermal insulation through the thickness of the panel. Additionally, the cured foam adheres to and acts to lock the mid-sections of stiffeners 50 in place, between the ends 52, to prevent movement of the stiffeners from side-to-side, in the directions of the panel side frame members 94. No additional liners or other structural members are required between the ends of the stiffeners. The cured-in-place structural combination of the foam and stiffeners eliminates the need to have the stiffeners, in the mid-portions between the ends 52, welded or otherwise separately adhered to the door skins to prevent such side-to-side movement.

In a method for making the insulated reinforced door panel of the invention, the ends 52 of a plurality of the stiffeners 50 are slid tightly into openings 82 of positioning members 80 to lock them in place mechanically. The stiffener sides 56 are oriented non-parallel with respect to the exterior panels 40, 42. The stiffeners may alternatively be welded or otherwise bonded at their ends 52 to positioning members 80. The positioning members 80 are secured to the upper and lower frame members 90. Optionally, the stiffeners are secured to frame members 90 directly. The opposite ends of upper and lower frame members 90 are attached to side frame members 94 formed by folding side edges of outer panel 42, and inner panel 40 is secured over and covering the frame members 90, 94 and internal spindles 50. The structural members and door skins may be assembled in any desired sequence.

Flowable foam may then be injected into the cavity of the door between the frame members, stiffeners and outer door skins. The injection may be made through foam slot(s) 96 at end of the door shell. Where the stiffeners contact the inside surfaces of panels 40, 42, a foam inlet will be provided between each pair of stiffeners, or between a stiffener and the door side frame member. The flowable foam may be a foam material that expands upon contact with the atmospheric air or alternately a two-part foam that expands upon mixing the two parts together. The stiffeners 50 may include openings or slots along the stiffener length which allow the expanding foam to flow from one cavity to an adjacent cavity. The flowable foam then hardens and is bonded to the inside surfaces of panels 40, 42, frame members 90, 94, and stiffeners 50. The foam acts both as an insulation material and bonds to the door skin and stiffeners as an adhesive.

Thus, the present invention provides an insulated door panel which structural framework may be made of steel and improves the structural integrity, is thermally efficient and provides an outer appearance free of weld marks.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

The invention claimed is:

1. An insulated panel which may be used as a door comprising:

a shell having spaced first and second exterior panels and elongated C-channel frame members adjacent edges of the panels;

a plurality of stiffeners in a shell interior portion extending along a length or width of the panels, ends of the stiffeners being received in positioning members secured to the elongated C-channel frame members at opposite ends of the door shell wherein each stiffener has an essentially continuous cross section along its length; and a hardenable insulation material between adjacent stiffeners and frame members in the shell interior portion, the hardenable insulation providing both thermal insulation and an adhesive to bond the exterior panels, frame members and stiffeners.

2. The panel of claim 1 wherein the elongated C-channel frame members have openings corresponding to a cross section of the ends of the stiffeners, the ends of the stiffeners being received within the frame member openings at opposite ends of the door shell.

3. The panel of claim 1 wherein the stiffeners have a rectangular cross-section with sides and corners, and wherein each of the stiffener sides are non-parallel with respect to the exterior panels.

4. The panel of claim 3 wherein the stiffeners are tubular and have a square cross-section, the diagonal dimension of the stiffener being at least half of the distance between the inside surfaces of the exterior panels.

5. The panel of claim 1 wherein the insulation material fills substantially all of the space between the adjacent exterior panels, stiffeners and elongated C-channel frame members in the shell interior portion.

6. The panel of claim 1 wherein the stiffeners and the liner panel are made of steel.

7. An insulated panel which may be used as a door comprising:

a shell having spaced first and second exterior panels and elongated C-channel frame members adjacent edges of the panels;

a plurality of stiffeners in a shell interior portion extending along a length or width of the panels, the stiffeners having a rectangular cross-section with sides and corners, each of the stiffener sides being oriented non-parallel with respect to the exterior panels and secured to positioning members disposed adjacent to the elongated C-channel frame members wherein each stiffener has an essentially continuous cross section along its length; and a hardenable insulation material between adjacent stiffeners and elongated C-channel frame members in the shell interior portion, the hardenable insulation providing both thermal insulation and an adhesive to bond the exterior panels, frame members and stiffeners.

8. The panel of claim 7 wherein the stiffeners are tubular and have a square cross-section, the diagonal dimension of the stiffeners being at least half of the distance between inside surfaces of the exterior panels.

9. The panel of claim 7 wherein the elongated C-channel frame members have openings corresponding to a cross section of the ends of the stiffeners, the ends of the stiffeners being received within the elongated C-channel frame member openings at opposite ends of the door shell.

10. The panel of claim 7 wherein the insulation material fills substantially all of the space between the adjacent exterior panels, stiffeners and elongated C-channel frame members in the shell interior portion.

11. The panel of claim 7 wherein the stiffeners and the liner panel are made of steel.

* * * * *